US011191338B2

(12) United States Patent
Zhong

(10) Patent No.: US 11,191,338 B2
(45) Date of Patent: Dec. 7, 2021

(54) ROTARY COSMETIC CONTAINER

(71) Applicant: SHYA HSIN PACKAGING INDUSTRY (CHINA) CO., LTD., Kunshan (CN)

(72) Inventor: Hua Zhong, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 17/057,109

(22) PCT Filed: Feb. 13, 2019

(86) PCT No.: PCT/CN2019/074892
§ 371 (c)(1),
(2) Date: Nov. 20, 2020

(87) PCT Pub. No.: WO2019/223370
PCT Pub. Date: Nov. 28, 2019

(65) Prior Publication Data

US 2021/0196026 A1 Jul. 1, 2021

(30) Foreign Application Priority Data

May 24, 2018 (CN) ..... 201810507863.6

(51) Int. Cl.
*B43K 21/08* (2006.01)
*A45D 40/02* (2006.01)
(Continued)

(52) U.S. Cl.
CPC ..... *A45D 40/023* (2013.01); *A45D 40/02* (2013.01); *A45D 40/04* (2013.01); *A45D 2040/0025* (2013.01); *A45D 2040/0037* (2013.01)

(58) Field of Classification Search
CPC ..... A45D 40/02; A45D 40/023; A45D 40/04; A45D 2040/0025; A45D 2040/0037
See application file for complete search history.

(56) References Cited

U.S. PATENT DOCUMENTS

2017/0196339 A1* 7/2017 Kim ..... A45D 40/065
2020/0060409 A1* 2/2020 Ok ..... A45D 33/24

FOREIGN PATENT DOCUMENTS

CN 202184308 U 4/2012
CN 102894636 A 1/2013
(Continued)

*Primary Examiner* — Jennifer C Chiang
(74) *Attorney, Agent, or Firm* — Bayramoglu Law Offices LLC

(57) ABSTRACT

A rotary cosmetic container includes an upper cover, an inner cover, a cartridge assembly, and a lower cover, which are arranged coaxially. The interior of the lower cover is vertically hollow, and the lower cover includes an upper end opening and a lower end opening. An internal thread is provided on the inside of the upper cover, and at least one first protrusion is provided on the outside of the inner cover. When the inner cover is placed in the upper cover, the first protrusion is engaged in the internal thread. When the upper cover rotates around the lower cover axially, the first protrusion is driven by the internal thread to drive the inner cover and the cartridge assembly to move up and down, so that the cartridge assembly retracts into or protrudes out of the lower end opening of the lower cover.

9 Claims, 9 Drawing Sheets

(51) Int. Cl.
*A45D 40/04* (2006.01)
*A45D 40/00* (2006.01)

(56) References Cited

FOREIGN PATENT DOCUMENTS

| | | | |
|---|---|---|---|
| CN | 206182601 | U | 5/2017 |
| CN | 206380880 | U | 8/2017 |
| CN | 206380881 | U | 8/2017 |
| CN | 207266664 | U | 4/2018 |
| CN | 108577138 | A | 9/2018 |
| CN | 208354882 | U | 1/2019 |
| KR | 20170060625 | A | 6/2017 |

* cited by examiner

ROTARY COSMETIC CONTAINER

CROSS REFERENCE TO THE RELATED APPLICATIONS

This application is the national phase entry of International Application No. PCT/CN2019/074892, filed on Feb. 13, 2019, which is based upon and claims priority to Chinese Patent Application No. 201810507863.6, filed on May 24, 2018, the entire contents of which are incorporated herein by reference.

TECHNICAL FIELD

The present invention relates to the technical filed of cosmetics, and more particularly, to a rotary cosmetic container.

BACKGROUND

In daily life, cosmetics such as lipstick and eye shadow have become an indispensable tool for people to improve their appearance. At present, lipstick is typically stored in a container that includes an upper cover, a bottom and a cartridge assembly. To facilitate the use of cosmetics, people usually need to pull out the upper cover and rotate the bottom to enable the lipstick to protrude out of the cartridge assembly. In this regard, the upper cover needs to be pulled out of the bottom every time the lipstick is used. This process easily makes the joint between the upper cover and the bottom become loose and even causes disengagement of the upper cover.

SUMMARY

In order to overcome the above-mentioned shortcomings, the present invention provides a rotary cosmetic container. When the cosmetic container is in use, the cartridge assembly moves downward to protrude out of the lower cover by rotating the upper cover, and then the user pulls out the protruding cartridge assembly to apply makeup. In this way, the upper cover is prevented from separating from the lower cover. The present invention has a novel structure and is convenient to operate.

To solve the above-mentioned technical problems, the present invention adopts the following technical solutions.

A rotary cosmetic container includes an upper cover, an inner cover, a cartridge assembly and a lower cover which are arranged coaxially. The interior of the lower cover is vertically hollow, and the lower cover includes an upper end opening and a lower end opening. An internal thread is provided on the inside of the upper cover, and at least one first protrusion is provided on the outside of the inner cover. When the inner cover is placed in the upper cover, the first protrusion is engaged in the internal thread. The upper cover is rotatably sleeved on the lower cover, the cartridge assembly penetrates the lower cover, and the upper end of the cartridge assembly is snap-fitted into the inner cover. When the upper cover rotates around the lower cover axially, the first protrusion is driven by the internal thread to drive the inner cover and the cartridge assembly to move up and down, so that the cartridge assembly retracts into or protrudes out of the lower end opening of the lower cover.

Preferably, the internal thread is provided on the inside of the upper end of the upper cover, and a pair of first protrusions engaged with the internal thread are symmetrically provided on the outside of the upper end of the inner cover.

Preferably, at least one second protrusion is provided on the outside of the lower end of the inner cover. A slide groove is provided vertically downward along the upper end opening at the upper end of the lower cover. When the inner cover moves up and down, the second protrusion slides in the slide groove.

Preferably, a pair of second protrusions are symmetrically provided on the outside of the lower end of the inner cover, and correspondingly, a pair of slide grooves matched with the second protrusions are arranged at the upper end of the lower cover.

Preferably, a first clamping point is provided at the lower end of the upper cover, and a second clamping point matched with the first clamping point is provided on the lower cover.

Preferably, the cartridge assembly includes a cartridge, a weight and a base. The weight is provided inside the base, and the lower end of the cartridge is fixedly connected to the base.

Preferably, a clamping member is provided on the inside of the inner cover, and a clamping strip matched with the clamping member is provided on the inside of the cartridge.

Preferably, the clamping member includes an elastic clamping claw, and the clamping claw is arranged in parallel with the inside of the inner cover. A gap is formed between the clamping claw and the inside of the inner cover. When the cartridge is inserted into the inner cover, the clamping strip is engaged in the gap.

Preferably, the shape of the base is similar to the shape of the lower cover, and the cartridge is fixedly connected to the base by an adhesive.

The present invention has the following advantages. The present invention mainly includes an upper cover, an inner cover, a lower cover and a cartridge assembly. The inner cover is connected to the internal thread of the upper cover through the first protrusion. The cartridge assembly is snap-fitted into the inner cover. The lower cover is snap-fitted with the upper cover, and the cartridge assembly is located in the inner cover and the lower cover. In use, the upper cover is counterclockwise rotated by 180°, and the internal thread provided inside the upper cover presses the first protrusion provided on the inner cover downward to drive the inner cover and the cartridge assembly to move down, so that the cartridge assembly protrudes out of the lower end opening of the lower cover. Then, the user pulls out the cartridge assembly from the lower cover to apply makeup. It is unnecessary to remove the upper cover when using the cosmetic container of the present invention, which avoids insecure fit between the upper cover and the lower cover or even the disengagement of the upper cover due to repeated insertion and pulling of the upper cover. In use, the cartridge assembly protrudes out of the lower end opening of the lower cover, and the user pulls out the cartridge assembly from the lower end opening to apply makeup. The cosmetic container of the present invention has a novel structure and is simple to operate.

Figure 1:
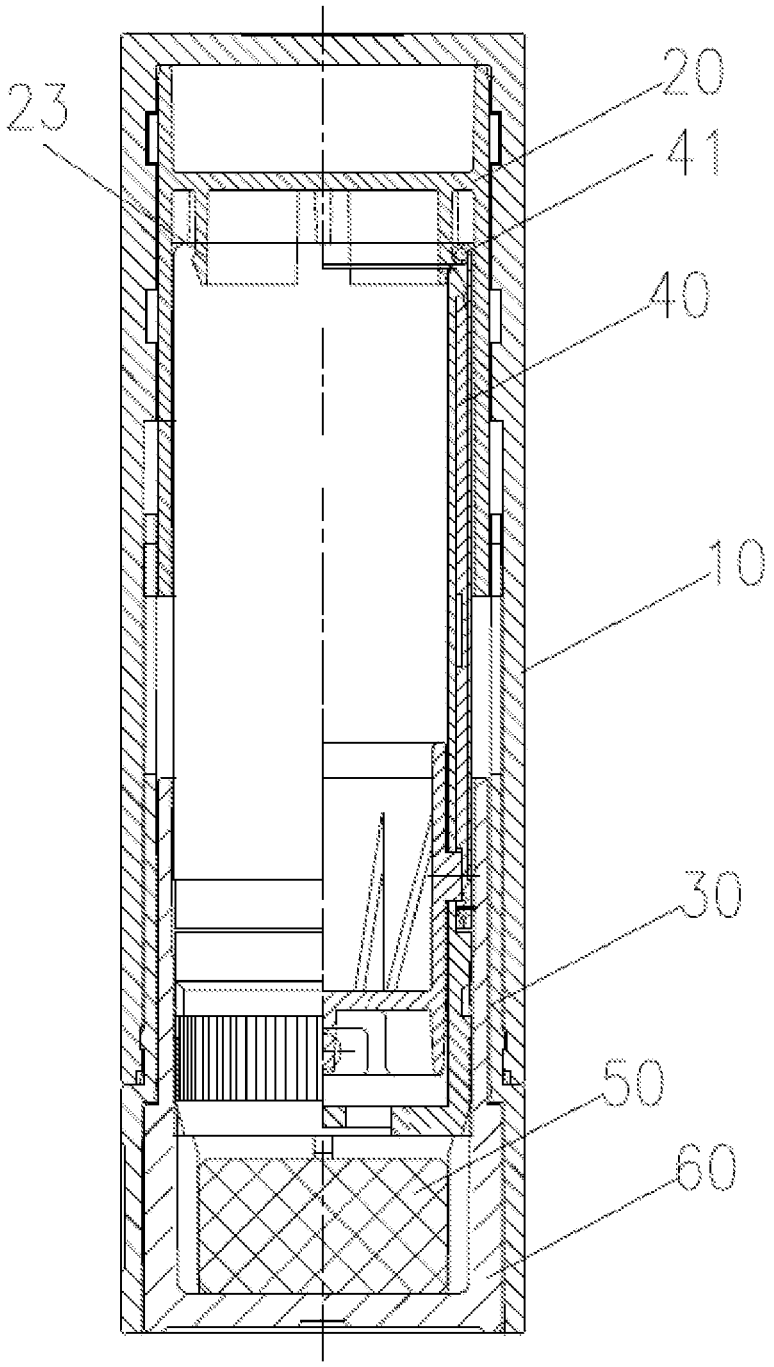
FIG. 1 is a schematic diagram of the structure of the present invention.
Figure 2:
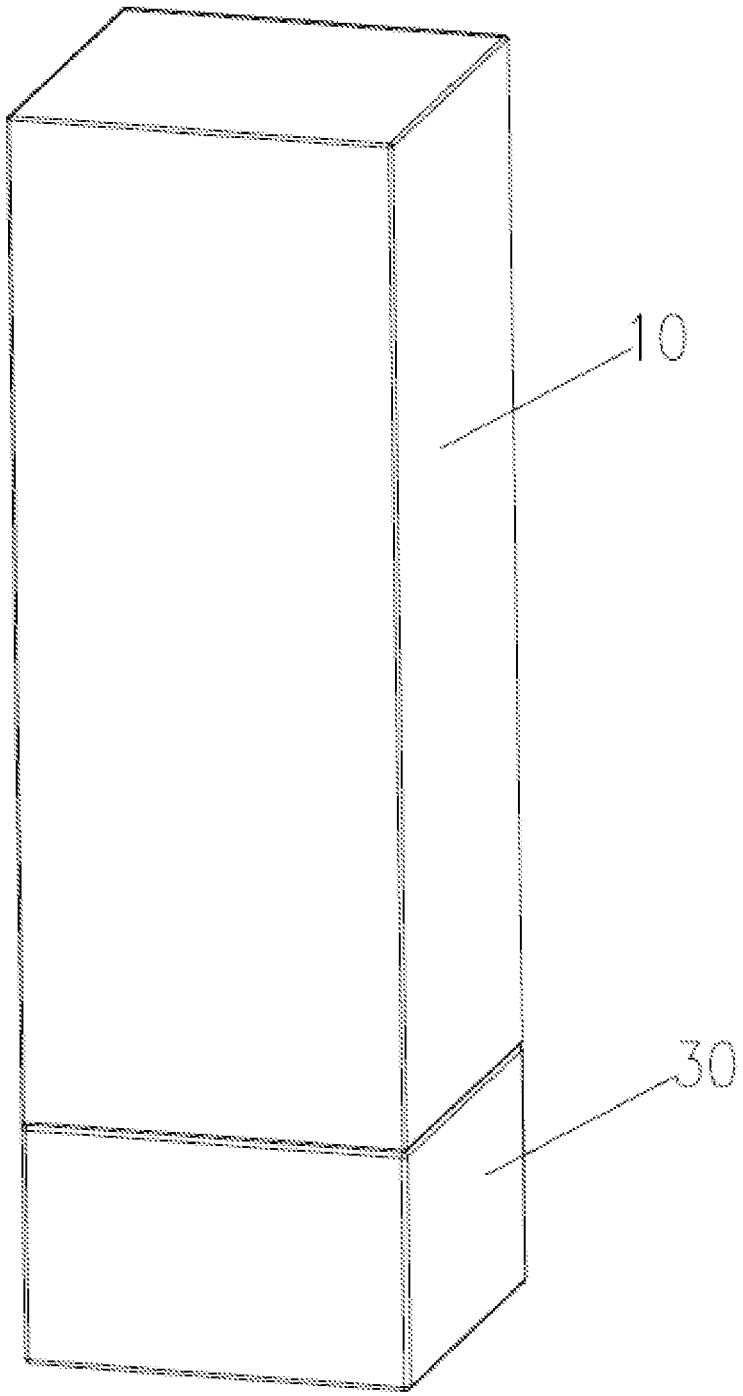
FIG. 2 is a perspective view of the structure of the present invention.
Figure 3:
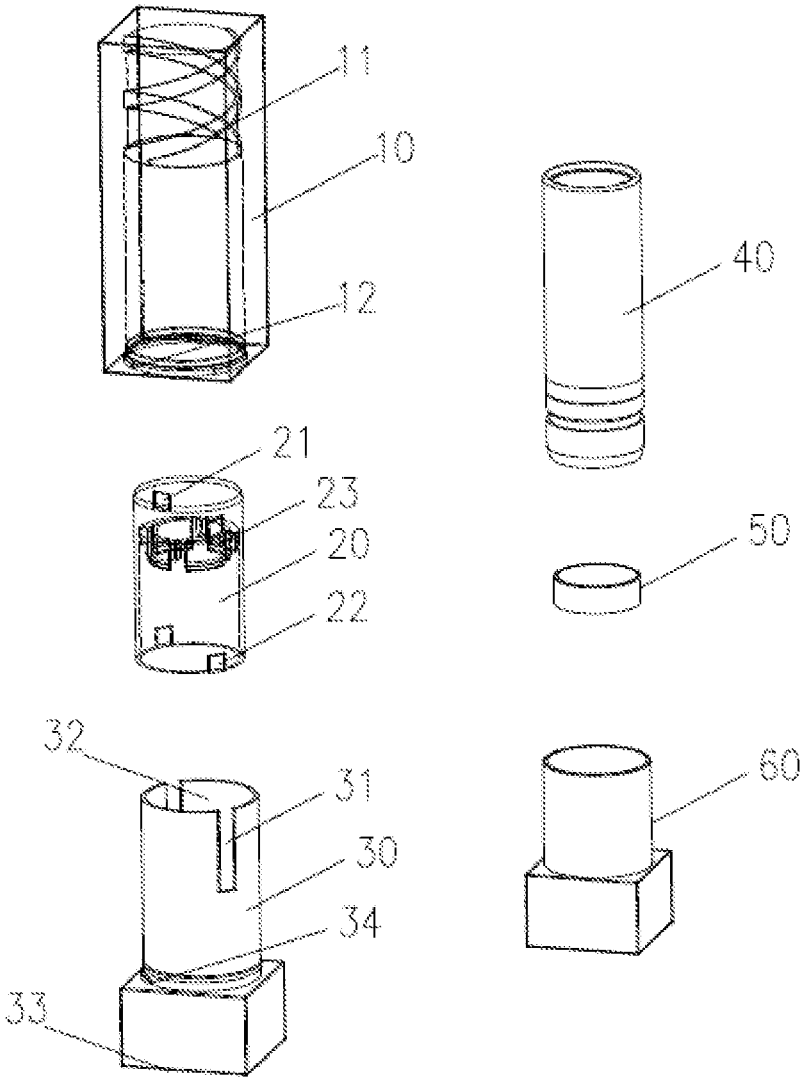
FIG. 3 is an exploded view of the present invention.

In the figures: 10—upper cover, 11—internal thread, 12—first clamping point, 20—inner cover, 21—first protrusion, 22—second protrusion, 23—clamping member, 30—lower cover, 31—slide groove, 32—upper end opening, 33—lower end opening, 34—second clamping point, 40—cartridge, 41—clamping strip, 50—weight, 60—base.

DETAILED DESCRIPTION OF THE EMBODIMENTS

The technical solutions in the embodiments of the present invention will be described clearly and completely in combination with the embodiments of the present invention. It is obvious that the described embodiments are only a part of the embodiments of the present invention, rather than all the embodiments of the present invention. Based on the embodiments of the present invention, all other embodiments obtained by those having ordinary skill in the art without creative efforts shall fall within the scope of protection of the present invention.

Embodiment

As shown in FIGS. 1-9, a rotary cosmetic container includes the upper cover 10, the inner cover 20, a cartridge assembly, and the lower cover 30, which are arranged coaxially. The interior of the lower cover 30 is vertically hollow, and the lower cover 30 includes the upper end opening 32 and the lower end opening 33. The internal thread 11 is provided on the inside of the upper cover 10, and at least one first protrusion 21 is provided on the outside of the inner cover. When the inner cover 20 is placed in the upper cover 10, the first protrusion 21 is engaged in the internal thread 11. The upper cover 10 is rotatably sleeved on the lower cover 30, the cartridge assembly penetrates the lower cover 30, and the upper end of the cartridge assembly is snap-fitted into the inner cover 20. When the upper cover 10 rotates around the lower cover 30 axially, the first protrusion 21 is driven by the internal thread 11 to drive the inner cover 20 and the cartridge assembly to move up and down, so that the cartridge assembly retracts into or protrudes out of the lower end opening 33 of the lower cover 30. Preferably, the internal thread 11 is provided on the inside of the upper end of the upper cover 10, and a pair of first protrusions 21 engaged with the internal thread are symmetrically provided on the outside of the upper end of the inner cover. The present invention is suitable for solid cosmetics such as lipstick and lip balm. The appearance of the present invention, namely the appearance of the upper cover and the lower cover, is not limited, for example, it can be circular, square or special-shaped. The lower end of the upper cover 10 is provided with an opening, and the inside of the upper cover 10 is a cylindrical hollow structure. The first protrusion is provided on the inner cover 20 and engaged in the internal thread of the upper cover 10. The cartridge assembly is snap-fitted into the inner cover 20. The lower cover is snap-fitted with the upper cover, and the cartridge assembly is located in the inner cover and the lower cover. In use, the upper cover 10 is counterclockwise rotated by 180°, and the internal thread provided inside the upper cover presses the first protrusion 21 provided on the inner cover downward to drive the inner cover and the cartridge assembly to move down, so that the cartridge assembly protrudes out of the lower end opening 33 of the lower cover. Then, the user pulls out the cartridge assembly from the lower cover to apply makeup. It is unnecessary to remove the upper cover when using the cosmetic container of the present invention, which avoids insecure fit between the upper cover and the lower cover or even the disengagement of the upper cover due to repeated insertion and pulling of the upper cover. In use, the cartridge assembly protrudes out of the lower end opening of the lower cover, and the user pulls out the cartridge assembly from the lower end opening to apply makeup. The cosmetic container of the present invention has a novel structure and is simple to operate.

Figure 5:
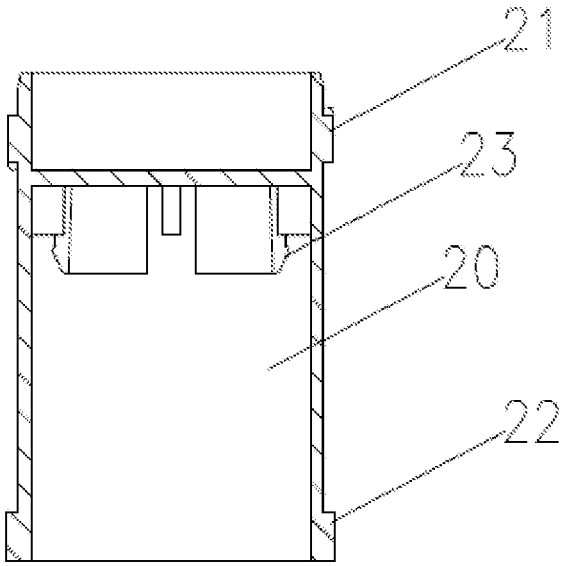
FIG. 5 is a schematic diagram of the structure of the inner cover in the present invention.
Figure 6:
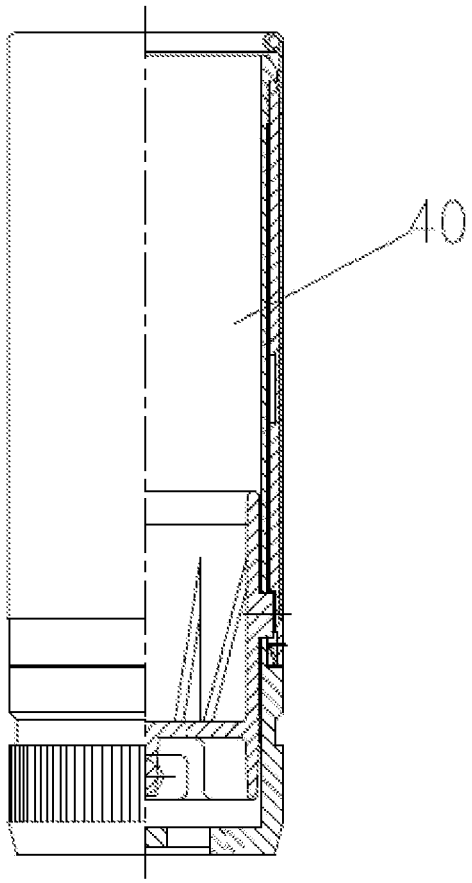
FIG. 6 is a schematic diagram of the structure of the cartridge in the present invention.

As shown in FIG. 5, at least one second protrusion 22 is provided on the outside of the lower end of the inner cover. The slide groove 31 is provided vertically downward along the upper end opening 32 at the upper end of the lower cover 30. When the inner cover moves up and down, the second protrusion 22 slides in the slide groove 31. Further, a pair of second protrusions 22 are symmetrically provided on the outside of the lower end of the inner cover, and correspondingly, a pair of slide grooves 31 matched with the second protrusions 22 are arranged at the upper end of the lower cover. The second protrusion 22 is limited in the vertically arranged slide groove to further ensure that the inner cover moves linearly up and down, and is stopped when the second protrusion 22 moves to the lowest end of the slide groove 31, thereby avoiding excessive downward movement of the inner cover.

Figure 4:
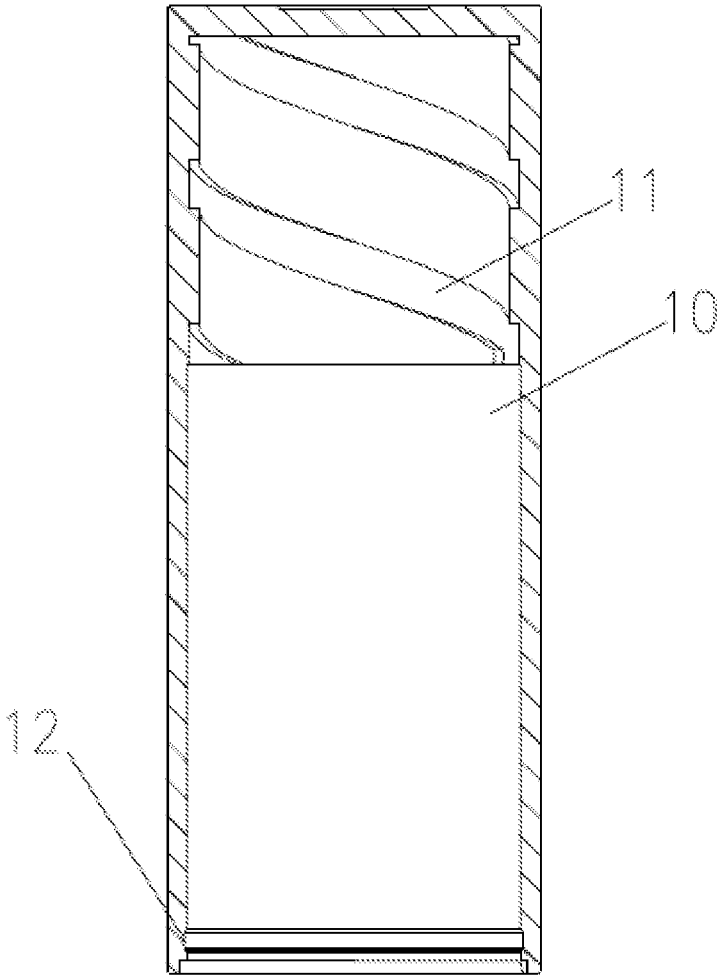
FIG. 4 is a schematic diagram of the structure of the upper cover in the present invention.
Figure 7:
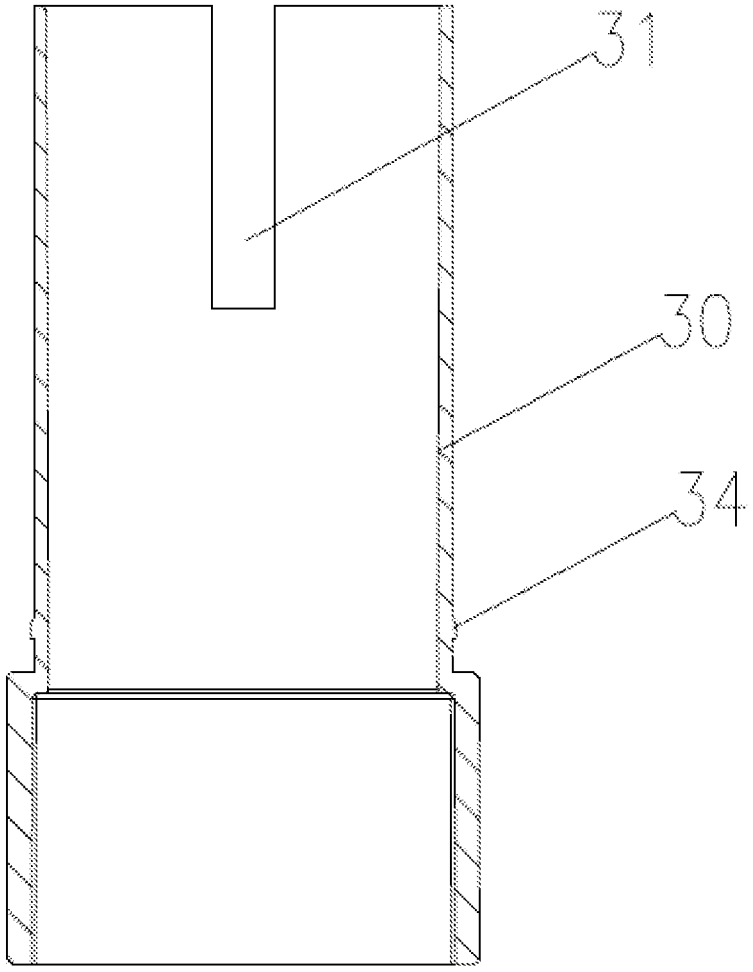
FIG. 7 is a schematic diagram of the structure of the lower cover in the present invention.
Figure 8:
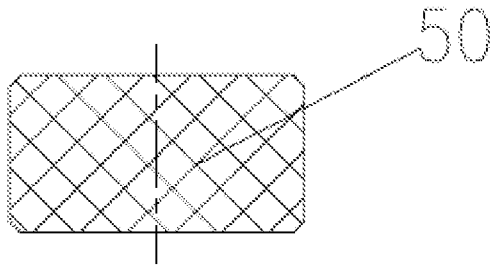
FIG. 8 is a schematic diagram of the structure of the weight in the present invention.
Figure 9:
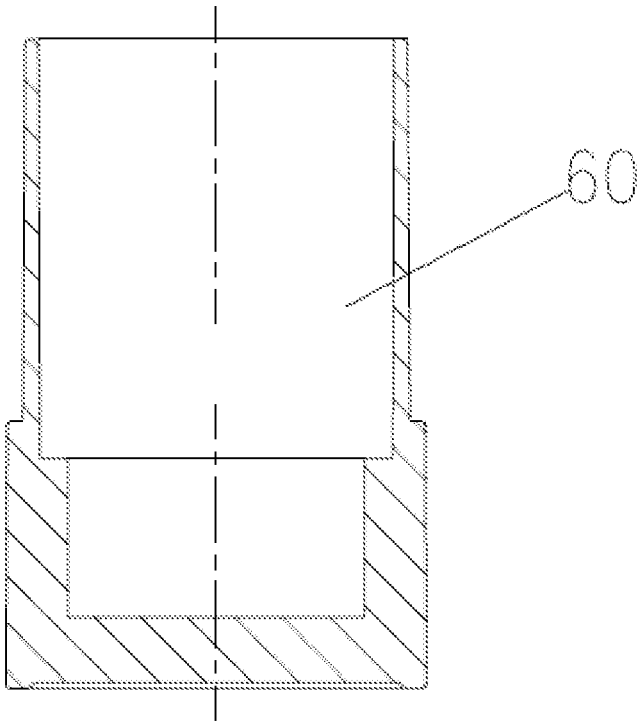
FIG. 9 is a schematic diagram of the structure of the base in the present invention.

As shown in FIGS. 4 and 7, the first clamping point 12 is provided at the lower end of the upper cover 10, and the second clamping point 34 matched with the first clamping point is provided on the lower cover 30. The upper cover and the lower cover are snap-fitted with each other through the first clamping point and the second clamping point. The lower end of the upper cover is provided with a first limiting point, and the lower cover is provided with a second limiting point. The first limiting point and the second limiting point press against each other to limit the rotation angle of the upper cover.

As shown in FIGS. 3, 6, 8 and 9, the cartridge assembly includes the cartridge 40, the weight 50 and the base 60. The weight 50 is provided inside the base 60, and the lower end of the cartridge is fixedly connected to the base. The clamping member 23 is provided on the inside of the inner cover 20, and the clamping strip 41 matched with the clamping member is provided on the inside of the cartridge 40. The clamping member 23 includes an elastic clamping claw, and the clamping claw is arranged in parallel with the inside of the inner cover. A gap is formed between the clamping claw and the inside of the inner cover, and when the cartridge is inserted into the inner cover, the clamping strip 41 is engaged in the gap. The base and the cartridge are bonded together by an adhesive. When the upper cover 10 is counterclockwise rotated by 180°, the base 60 protrudes out of the lower end opening of the lower cover 30. At this time, the user grasps the base and pulls the base downward, then the clamping strip 41 on the cartridge is released from the restriction of the clamping member 23 of the inner cover such that the cartridge is separated from the inner cover. The shape of the base 60 is similar to the shape of the lower cover 30, and the cartridge 40 is fixedly connected to the base 60 by an adhesive.

Figure 10:
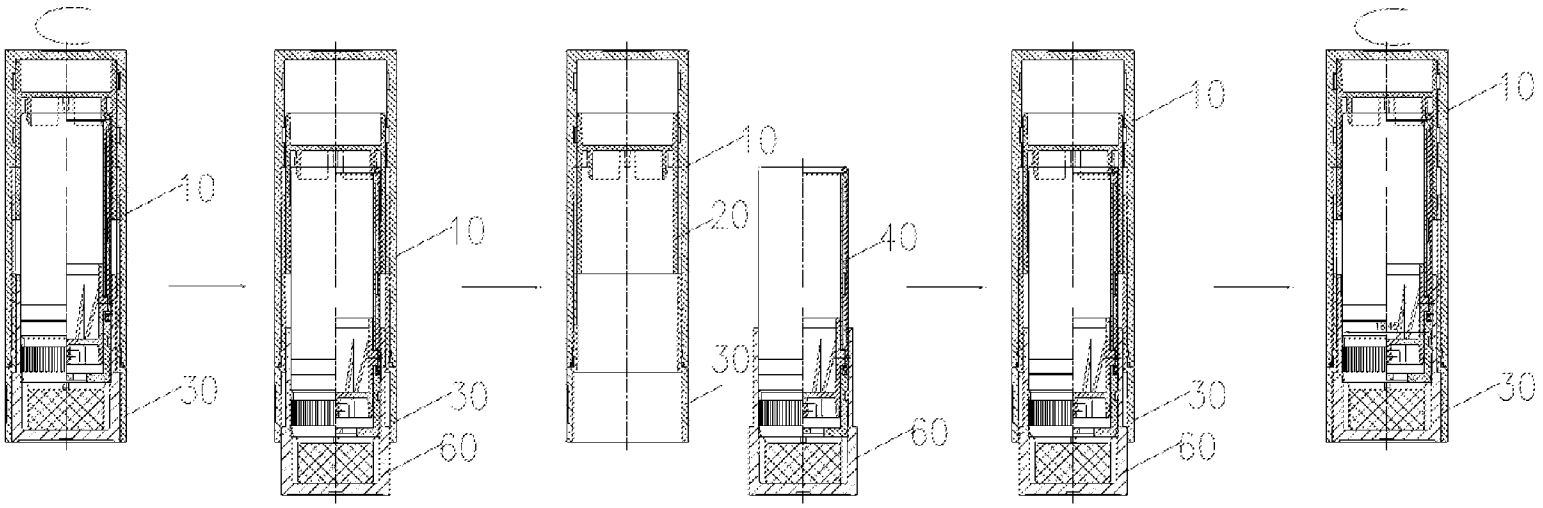
FIG. 10 is a schematic diagram of the operation process of the present invention.

In use, as shown in FIG. 10, the straight arrow represents the operation sequence, and the curved arrow represents the rotation direction of the upper cover. The upper cover 10 is counterclockwise rotated by 180°, and the internal thread provided inside the upper cover presses the first protrusion 21 provided on the inner cover downward, so that the inner cover and the cartridge assembly move down, and the base 60 protrudes out of the lower end opening of the lower cover 30. The user grasps the base and pulls the base downward, so that the clamping strip 41 on the cartridge is released from the restriction of the clamping member 23 of the inner cover to enable the cartridge to be separated from the inner cover. Then, the user pulls out the base 60 and the cartridge 40 to apply makeup using the cosmetics in the cartridge. After the makeup is applied, the cartridge assembly is inserted into the upper cover and the lower cover, so that the clamping strip 41 on the cartridge is engaged on the clamping member 23 of the inner cover. Then, the upper cover 10 is clockwise rotated by 180°, and the inner cover drives the cartridge assembly to move up along the internal thread of the upper cover, so that the cartridge assembly completely retracts into the upper cover and the lower cover.

It should be pointed out that, for those having ordinary skill in the art, various transformations and improvements can be made without departing from the inventive concept of the present invention, and these transformations and improvements shall fall within the scope of protection of the present invention. Therefore, the scope of protection of the present invention shall be based on the appended claims.

What is claimed is:

1. A rotary cosmetic container, comprising an upper cover, an inner cover, a cartridge assembly and a lower cover, wherein the upper cover, the inner cover, the cartridge assembly and the lower cover are arranged coaxially;

an interior of the lower cover is vertically hollow, and the lower cover comprises an upper end opening and a lower end opening;

an internal thread is provided on an inside of the upper cover, and at least one first protrusion is provided on an outside of the inner cover;

when the inner cover is placed in the upper cover, the at least one first protrusion is engaged in the internal thread;

the upper cover is rotatably sleeved on the lower cover, the cartridge assembly penetrates the lower cover, and an upper end of the cartridge assembly is snap-fitted into the inner cover; and when the upper cover rotates around the lower cover axially, the at least one first protrusion is driven by the internal thread to drive the inner cover and the cartridge assembly to move up and down, and the cartridge assembly retracts into or protrudes out of the lower end opening of the lower cover.

2. The rotary cosmetic container according to claim 1, wherein, the internal thread is provided on an inside of an upper end of the upper cover, and a pair of first protrusions engaged with the internal thread are symmetrically provided on an outside of an upper end of the inner cover.

3. The rotary cosmetic container according to claim 1, wherein, at least one second protrusion is provided on an outside of a lower end of the inner cover; a slide groove is provided vertically downward along the upper end opening at an upper end of the lower cover; when the inner cover moves up and down, the at least one second protrusion slides in the slide groove.

4. The rotary cosmetic container according to claim 3, wherein, a pair of second protrusions are symmetrically provided on the outside of the lower end of the inner cover, and correspondingly, a pair of slide grooves matched with the pair of second protrusions are arranged at the upper end of the lower cover.

5. The rotary cosmetic container according to claim 1, wherein, a first clamping point is provided on a lower end of the upper cover, and a second clamping point matched with the first clamping point is provided on the lower cover.

6. The rotary cosmetic container according to claim 1, wherein, the cartridge assembly comprises a cartridge, a weight and a base; the weight is provided inside the base, and a lower end of the cartridge is fixedly connected to the base.

7. The rotary cosmetic container according to claim 6, wherein, a clamping member is provided on an inside of the inner cover, and a clamping strip matched with the clamping member is provided on an inside of the cartridge.

8. The rotary cosmetic container according to claim 7, wherein, the clamping member comprises an elastic clamping claw, and the elastic clamping claw is arranged in parallel with the inside of the inner cover; a gap is formed between the elastic clamping claw and the inside of the inner cover; when the cartridge is inserted into the inner cover, the clamping strip is engaged in the gap.

9. The rotary cosmetic container according to claim 6, wherein, a shape of the base is similar to a shape of the lower cover, and the cartridge is fixedly connected to the base by an adhesive.

* * * * *